US007618038B2

(12) United States Patent
Aida

(10) Patent No.: US 7,618,038 B2
(45) Date of Patent: Nov. 17, 2009

(54) IMAGE FORMING APPARATUS AND MEDIUM FEEDING MECHANISM

(75) Inventor: Koji Aida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 388 days.

(21) Appl. No.: 11/250,214

(22) Filed: Oct. 14, 2005

(65) Prior Publication Data

US 2006/0082044 A1 Apr. 20, 2006

(30) Foreign Application Priority Data

Oct. 20, 2004 (JP) ..... 2004-305542

(51) Int. Cl.
*B65H 1/00* (2006.01)

(52) U.S. Cl. ..... 271/162; 271/171; 271/145

(58) Field of Classification Search ..... 271/171, 271/145, 162, 9.09; 399/393
See application file for complete search history.

(56) References Cited

U.S. PATENT DOCUMENTS 6,916,020 B2 * 7/2005 Hasegawa ..... 271/171

FOREIGN PATENT DOCUMENTS

| | | | |
|---|---|---|---|
| JP | 61-21732 | U | 2/1986 |
| JP | 2004-143017 | A | 5/2000 |
| JP | 2000302297 | A | 10/2000 |
| JP | 2003063666 | A | 3/2003 |
| JP | 2004-123316 | A | 4/2004 |

* cited by examiner

*Primary Examiner*—Kaitlin S Joerger
(74) *Attorney, Agent, or Firm*—Panitch Schwarze Belisario & Nadel LLP

(57) ABSTRACT

An image forming apparatus includes a main body (110) and a sheet feeding tray (600) that stores the stack of media (601). The sheet feeding tray (600) includes retractable guides (620) that restrict lateral ends of the media (601) stacked in the sheet feeding tray (600). The retractable guides (620) can be kept laid when the sheet feeding tray (600) is not in use. Therefore, even when the retractable guides (620) are sufficiently large, the sheet feeding tray (600) can be compact when the sheet feeding tray (600) is not in use. Thus, when the sheet feeding tray (600) is housed in the main body (110), it is not necessary to provide a large recess space in the main body (110), and therefore it is not necessary to increase the size of the image forming apparatus.

34 Claims, 14 Drawing Sheets

IMAGE FORMING APPARATUS AND MEDIUM FEEDING MECHANISM

BACKGROUND OF THE INVENTION

This invention relates to an image forming apparatus having a medium storing portion that stores a plurality of media (printing sheets or the like), and relates to a medium feeding mechanism.

There is an image forming apparatus having a sheet feeding tray called as, for example, a manual tray or a multi purpose tray (MPT). Such a sheet feeding tray is configured to support a plurality of media (printing sheets or the like) on a horizontal placing surface, when the sheet feeding tray is in use. The sheet feeding tray is housed in a main body of the image forming apparatus, when the sheet feeding tray is not in use. In order to guide both lateral ends of the medium, the sheet feeding tray has sheet guides raised substantially perpendicularly to the placing surface. Each sheet guide has a sufficient length in the feeding direction of the medium, and a sufficient height in the direction substantially perpendicular to the placing surface. Therefore, a sufficient recess space is provided in the main body of the image forming apparatus for preventing the interference with the sheet guides when the sheet feeding tray is housed in the main body of the image forming apparatus, as disclosed in, for example, Japanese Laid-Open Patent Publication No. 2004-123316 (see FIG. 2).

As the length of each sheet guide in the feeding direction increases, the effect of preventing the skew the medium is enhanced. As the height of each sheet guide increases, the amount of the media storable in the sheet feeding tray becomes large. However, if the size of each sheet guide increases, it is necessary to provide a large recess space in the main body of the image forming apparatus, and therefore the image forming apparatus becomes larger. Particularly, in recent years, the downsizing of the image forming apparatus is being developed, and components thereof become concentrated (as the image forming apparatus becomes highly functional), and therefore it becomes difficult to provide a large recess space in the main body of the image forming apparatus.

SUMMARY OF THE INVENTION

An object of the present invention is to provide a large guide without increasing the size of an image forming apparatus.

According to the invention, there is provided an image forming apparatus including a medium storing portion attached to a main body. The medium storing portion includes a placing surface on which at least one medium can be placed, a retractable guide that guides an end of the medium placed on the placing surface.

With such an arrangement, since the retractable guide is used to guide the end of the medium, the retractable guide can be laid when the medium storing portion is not in use. Thus, even when the retractable guide is large (sufficient for preventing the skew of the medium and for storing a large amount of media), it is possible to reduce the size of the medium storing portion when not in use. In the case where the medium storing portion is housed in the main body, a recess space in the main body can be smaller. Thus, it is not necessary to increase the size of the image forming apparatus.

DETAILED DESCRIPTION OF THE PREFERRED EMBODIMENT

Embodiments of the present invention will be described with reference to the attached drawings.

First Embodiment

Figure 1:
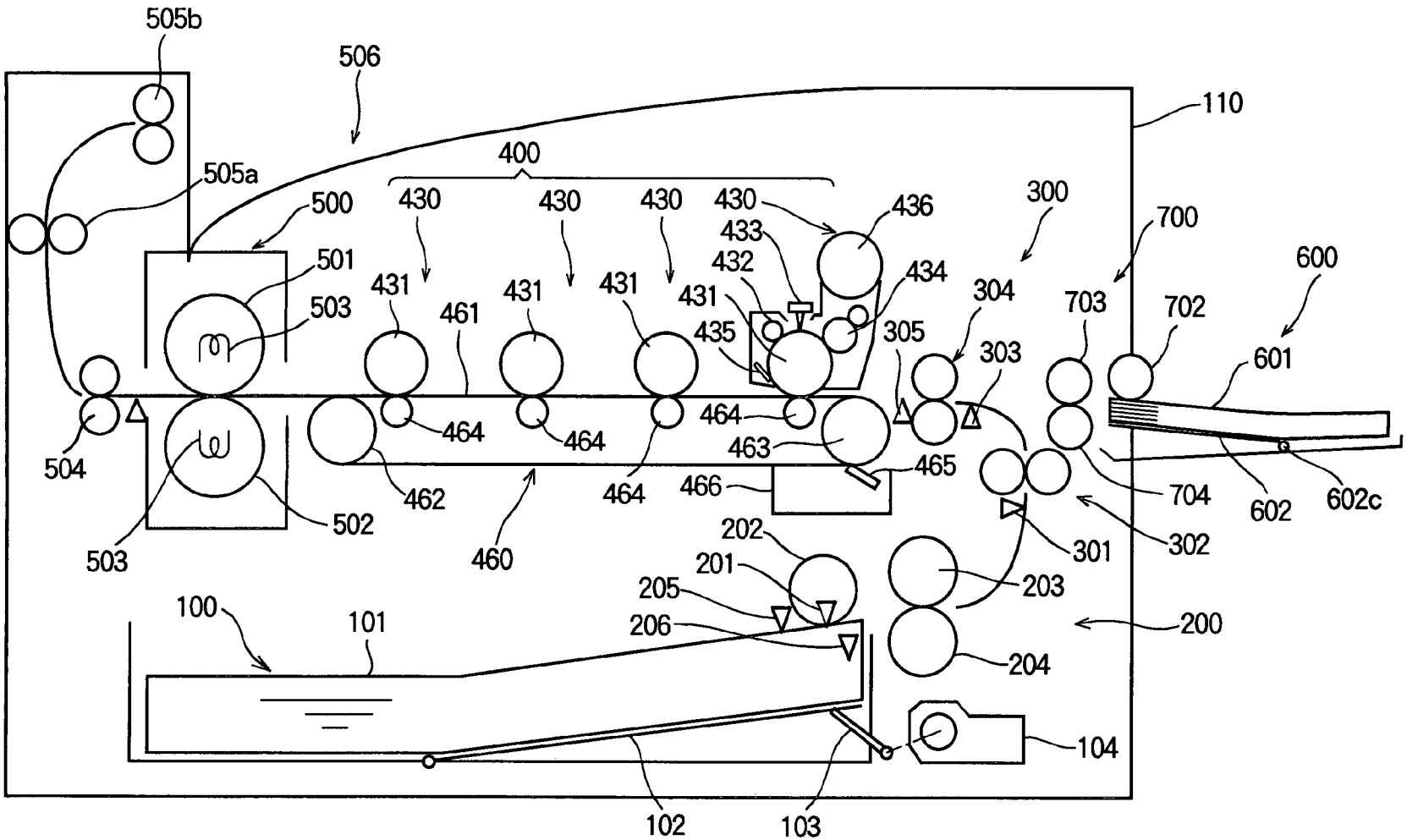
FIG. 1 is a side view showing a basic configuration of an image forming apparatus according to the first embodiment of the present invention.

FIG. 1 is a side view showing a basic configuration of an image forming apparatus according to the first embodiment of the present invention. The image forming apparatus includes a main body 110 and a sheet feeding tray (i.e., a multi purpose tray) 600 attached to the main body 110. In the main body 110, an inner tray 100 that stores a plurality of media (for example, printing sheets) 101, a pickup portion 200 that picks up the medium 101 from the inner tray 100 one by one, a carrying portion 300 that carries the medium 101 (having been picked up by the pickup portion 200), an image forming portion 400 that forms a toner image on the medium 101, and a fixing portion 500 that fixes the toner image to the medium 101 are provided.

The inner tray 100 is detachably attached to, for example, a lower part of the main body 110. The inner tray 100 includes a placing plate 102 on which a plurality of media 101 are placed. The inner tray 100 further includes a lift lever 103 that lifts the placing plate 102 from below and a motor 104 for driving the lift lever 103. When the lift lever 103 swings upward by the rotation of the motor 104, the lift lever 103 lifts the placing plate 102 upward, so that the media 101 placed on the placing plate 102 move upward. When a lifting position sensor 201 detects the media 101 reaching a predetermined position, the rotation of the motor 104 is stopped according to the detection of the lifting position sensor 201.

The pickup portion 200 is disposed on the right side of the inner tray 100 in FIG. 1. The pickup portion 200 includes a pickup roller 202 that contacts the surface of the uppermost medium 101 of the stacked media 101 lifted by the lift lever 103. By the rotation of the pickup roller 202, the medium 101 of the stacked media 101 in the inner tray 100 is brought out of the inner tray 100 one by one. Adjacent to the pickup roller 202, a pair of rollers (a feed roller 203 and a retard roller 204) are provided for separating one medium 101 from other media 101. The pickup portion 200 further includes a medium presence detecting portion 205 for, detecting the presence and absence of the medium 101 in the inner tray 100, and a medium residual amount detecting portion 206 for detecting the residual amount of the medium 101 in the inner tray 100.

The carrying portion 300 is disposed on substantially an upper position of the pickup portion 200. The carrying portion 300 includes a pair of carrying rollers 302 that correct the skew of the medium 101 (having been picked up by the pickup portion 200) and further carry the medium 101, and another pair of carrying rollers 304 that carry the medium 101 toward the image forming portion 400. A medium detection sensor 301 is provided on the upstream side of the carrying rollers 302. Further, medium detection sensors 303 and 305 are provided respectively on the upstream side and the downstream side of the carrying rollers 304. A not shown controller of the carrying portion 300 drives the carrying rollers 302 to start rotating when a predetermined time has passed after the medium 101 reaches a nip portion of the carrying rollers 302 based on the detection signal from the medium detection sensor 301, so as to correct the skew of the medium 101. The carrying rollers 304 start rotating when the medium 101 passes the medium detection sensor 303 and supply the medium 101 to the image forming portion 400 without stopping the medium 101. The medium 101 is detected by the medium detection sensor 305 after passing the carrying rollers 304.

The image forming portion 400 includes four toner image forming portions 430, and a transfer portion 460 disposed in opposition to the toner image forming portions 430. Each toner image forming portion 430 includes a photosensitive drum 431 that carries a toner image thereon. Further, each toner image forming portion 430 includes a charging roller 432 that uniformly charges the surface of the photosensitive drum 431, an exposing device 433 (for example, an LED array) that forms a latent image on the surface of the photosensitive drum 431, a developing roller 434 that develops the latent image on the photosensitive drum 431 with toner, a toner cartridge 436 that supplies the toner to the developing roller 434, and a cleaning blade 435 that removes the residual toner on the surface of the photosensitive drum 431.

The transfer portion 460 includes four transfer rollers 464 disposed respectively in opposition to the photosensitive drums 431 of the toner image forming portions 430. The transfer portion 460 further includes a drive roller 462 and a tension roller 463 disposed on both sides of the transfer rollers 464 in the direction along which the transfer rollers 464 are arranged, and a transfer belt 461 is stretched around the drive roller 462 and the tension roller 463. The drive roller 462 is driven by a not shown driving portion. The tension roller 463 is pushed in the direction away from the drive roller 462 for applying the tension to the transfer belt 461. The transfer belt 461 absorbs the medium 101 by means of electrostatic force and carries the medium 101. The transfer belt 461 is sandwiched between the photosensitive drums 431 and the transfer rollers 464. The transfer portion 460 further includes a cleaning blade 465 that scrapes the residual toner from the transfer belt 461 and a toner box 466 for storing the toner scraped by the cleaning blade 465.

The toner image forming portions 430 and the transfer portion 460 are driven in synchronization with each other, so that the toner images of respective colors (for example, yellow, magenta, cyan and black) formed on the photosensitive drums 431 are transferred to the medium 101 absorbed and carried by the transfer belt 461.

The fixing portion 500 is disposed on the downstream side of the image forming portion 400. The fixing portion 500 includes an upper roller 501 and a lower roller 502 respectively provided with halogen lamps (i.e., heat sources). The upper roller 501 and the lower roller 502 sandwich the medium 101 carried by the transfer belt 461, and apply heat and pressure to the medium 101, so that the toner is molten and fixed to the medium 101. Eject rollers 504, 505*a* and 505*b* are disposed on the downstream side of the fixing portion 500, and eject the medium 101 (to which the toner image has been transferred) to a stacker portion 506 on the main body 110.

Next, a sheet feeding tray (i.e., a medium storing portion) 600 according to the first embodiment of the present invention will be described. The sheet feeding tray 600 is attached to the side of the main body 110 so that the sheet feeding tray 600 positions on an extension line (which is a substantially horizontal line) with respect to the image forming portion 400 and the carrying rollers 304. The sheet feeding tray 600 is also called as a manual tray or a multi purpose tray (MPT), and is used for stacking a various kind of media (for example, a thin sheet, a thick sheet, a narrow sheet, a lengthy sheet or a special sheet). In particular, since a carrying path of the medium 101 from the inner tray 100 is curved at the carrying portion 300, the sheet tray 600 is used for a thick sheet which has a strength and does not easily curve. Further, the sheet tray 600 is also used for a lengthy sheet which can not be stored in the inner tray 100.

A pickup portion 700 is provided in the main body 110. The pickup portion 700 picks up the medium 601 in the sheet feeding tray 600, and feds the medium 601 to the carrying rollers 304. The pickup portion 700 includes a pickup roller 702 that contacts the surface of the uppermost medium 601 of the stacked media 601 on the sheet feeding tray 600. The pickup portion 700 further includes a feed roller 703 and a retard roller 704 that separate the medium 601 picked up by the pickup roller 702 from other media 601 and feed the medium 601 to the carrying rollers 304. Further, a not-shown medium presence detecting portion for detecting the presence or absence of the medium 601 is provided in the pickup portion 700, and a not-shown medium residual amount detecting portion for detecting the residual amount of the medium 601 is provided in the pickup portion 700.

The pickup roller 702, the feed roller 703 and the retard roller 704 are driven in synchronization with each other, as is the case with the pickup roller 202, the feed roller 203 and the retard roller 204. The medium 601 picked up by the pickup roller 702 is carried by the feed roller 703 and the retard roller 704 to the carrying rollers 304, and carried by the carrying rollers 304 to the image forming portion 400. In the image forming portion 400, the medium 601 is carried by the transfer belt 641, and the toner image is transferred to the medium 601, as is the case with the medium 101 fed from the inner tray 100. The medium 601 is further fed to the fixing portion 500, and the toner image is fixed to the medium 601. The sheet feeding tray 600 and the pickup portion 700 constitute a sheet feeding mechanism (i.e., a medium feeding mechanism) that feeds the medium 601 to the main body 110.

The sheet feeding tray 600 is swingable between a horizontal position in which a placing plate 602 (for placing the medium 601) is almost horizontally supported, and a vertical position in which the placing plate 602 is almost vertically supported. When the sheet feeding tray 600 is not in use, the sheet feeding tray 600 is in the vertical position. When the sheet feeding tray 600 is in use, the sheet feeding tray 600 is swung to the horizontal position at almost 90 degrees as shown in FIG. 1.

Figure 2:
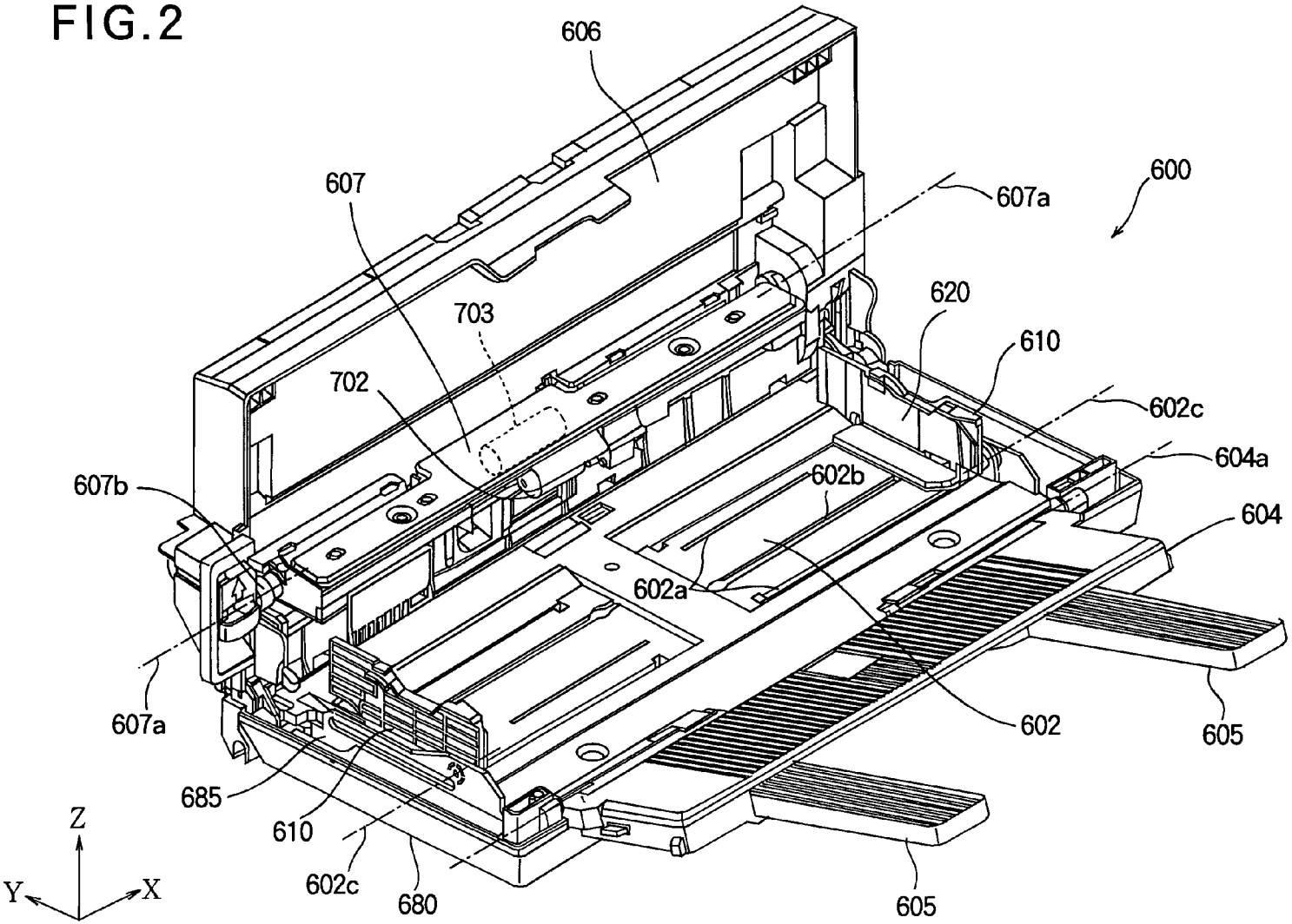
FIG. 2 is a perspective view showing a sheet feeding tray of the image forming apparatus according to the first embodiment of the present invention, in a state where a supplemental tray is opened.
Figure 3:
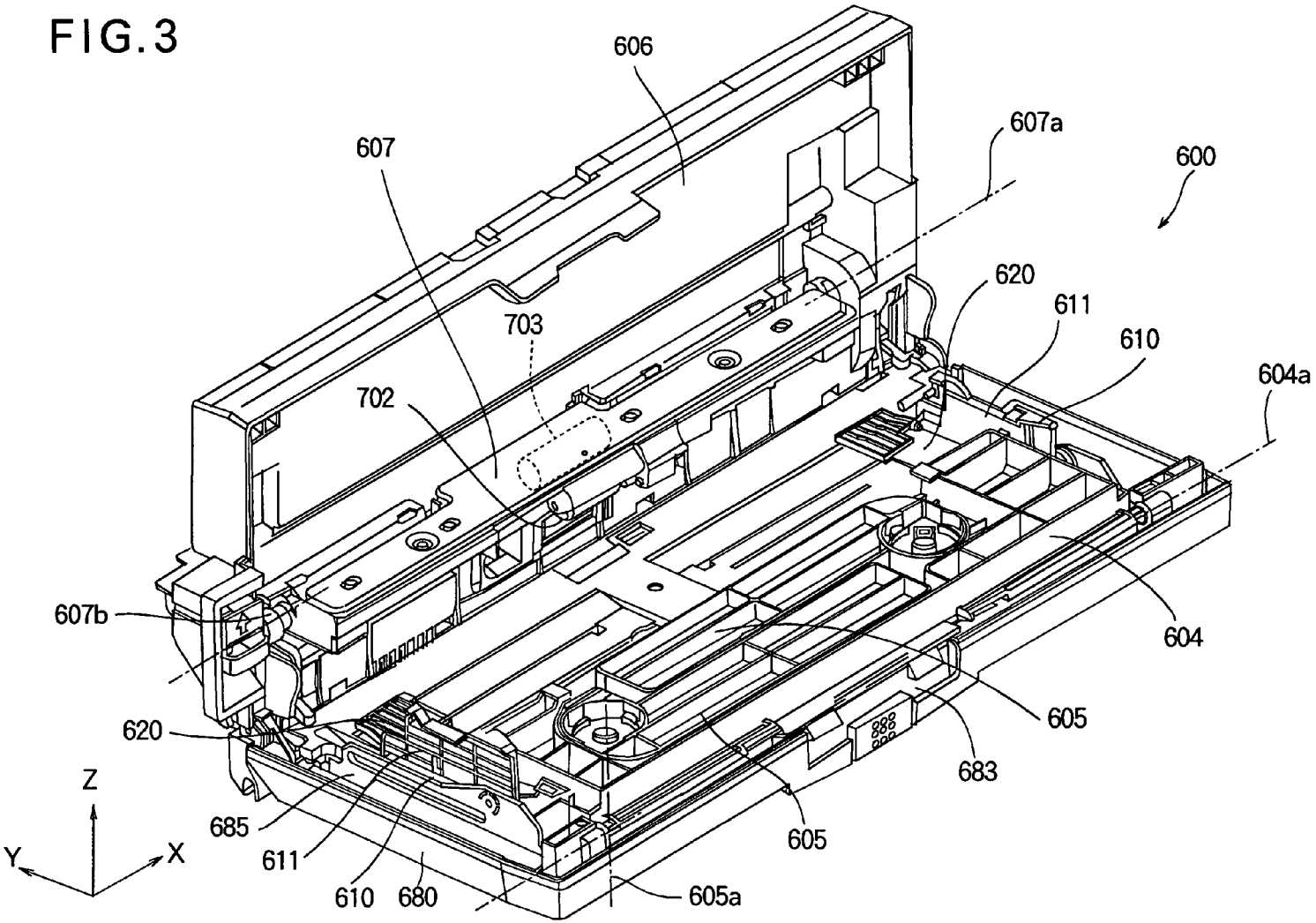
FIG. 3 is a perspective view showing the sheet feeding tray of the image forming apparatus according to the first embodiment of the present invention, in a state where the supplemental tray is closed.
Figure 4:
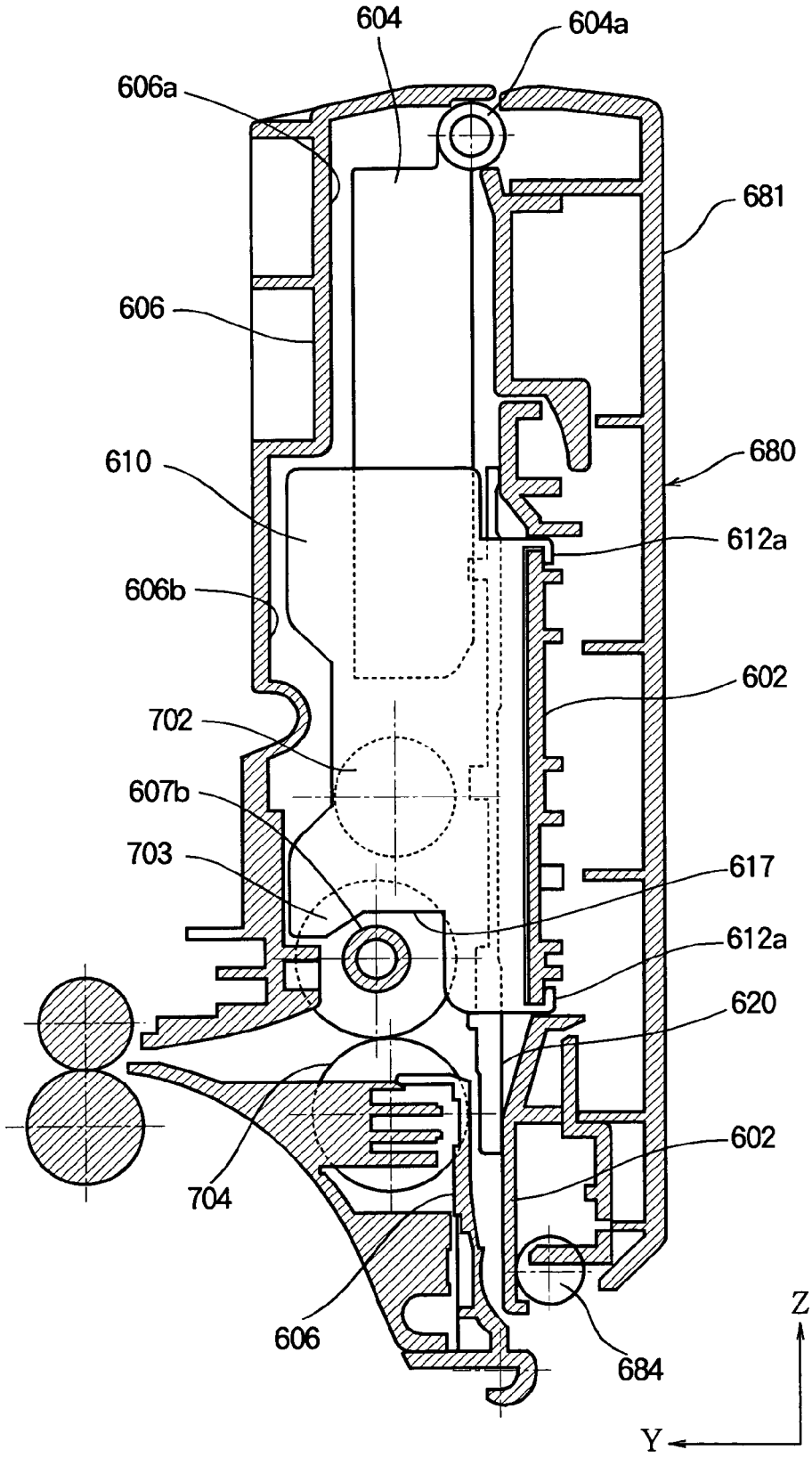
FIG. 4 is a sectional view showing the image forming apparatus according to the first embodiment of the present invention, in a state where the sheet feeding tray is closed.

FIGS. 2 and 3 are perspective views illustrating the condition that the sheet feeding tray 600 is swung to the horizontal position. In FIG. 2, the feeding direction of the medium 601 (FIG. 1) is defined as Y direction, and the width direction of the medium 601 is defined as X direction. Z direction (here, a vertical direction) is defined to be perpendicular to both of the X direction and the Y direction. Regarding the Y direction, the direction toward the main body 100 is +Y direction, and the opposite direction is −Y direction. FIG. 4 is a sectional view cut along YZ plane, showing the condition that the sheet feeding tray 600 is swung to the vertical position.

As shown in FIG. 2, the sheet feeding tray 600 includes a tray casing 680 swingably supported by the main body 110 via a support shaft 684 (FIG. 4). The tray casing 680 includes a base plate 681 (FIG. 4) in the form of, for example, a rectangle, and side walls formed on four sides of the base plate 681. When the sheet feeding tray 600 is in the vertical position, the base plate 681 of the tray casing 680 constitutes a part of the side wall of the main body 110. A grip portion 683 (FIG. 3) is formed on an end of the tray casing 680 opposite to the support shaft 684, which is to be gripped by a user for swinging the sheet feeding tray 600.

At almost the center of the tray casing 680, the above described placing plate 602 (for placing the medium 601) is provided almost in parallel to the base plate 681 (see FIG. 4). When the sheet feeding tray 600 is in the horizontal position, the upper surface of the placing plate 602 constitutes a placing surface on which the media 601 are stacked. The placing plate 602 is swingable about a support shaft 602*c* extending in the X direction. A part of the placing plate 602 in +Y direction is lifted upward (toward the pickup roller 702) by means of a not shown mechanism. A pair of guide members 610 whose positions are adjustable along the X direction are provided on the placing plate 602. Further, a pair of retractable guides 620 for restricting both lateral ends (ends in the width direction) of the media 601 are provided.

A first supplemental tray 604 is swingably provided on an end of the tray casing 680 in −Y direction. The first supplemental tray 604 is swingably supported about support shafts 604*a* extending in the X direction, and swings between a closing position (FIG. 3) where the first supplemental tray 604 is overlapped on the placing plate 602 in parallel to each other, and an opening position (FIG. 2) where the placing plate 604 swings about the support shaft 604*a* at, for example, about 180 degrees from the closing position.

A pair of second supplemental trays 605 in the form of levers are swingably provided on the first supplemental tray 604. The second supplemental trays 605 are symmetrically disposed with respect to the center in the X direction. The second supplemental trays 605 are swingably supported about a pair of support shafts 605*a* (FIG. 3) defined to be perpendicular to the surface of the first supplemental tray 604. Each second supplemental tray 605 swings between a projecting position (FIG. 2) where the second supplemental tray 605 projects from the first supplemental tray 604, and a housed position (FIG. 3) where the second supplemental tray 605 is housed in the first supplemental tray 604.

Figure 5:
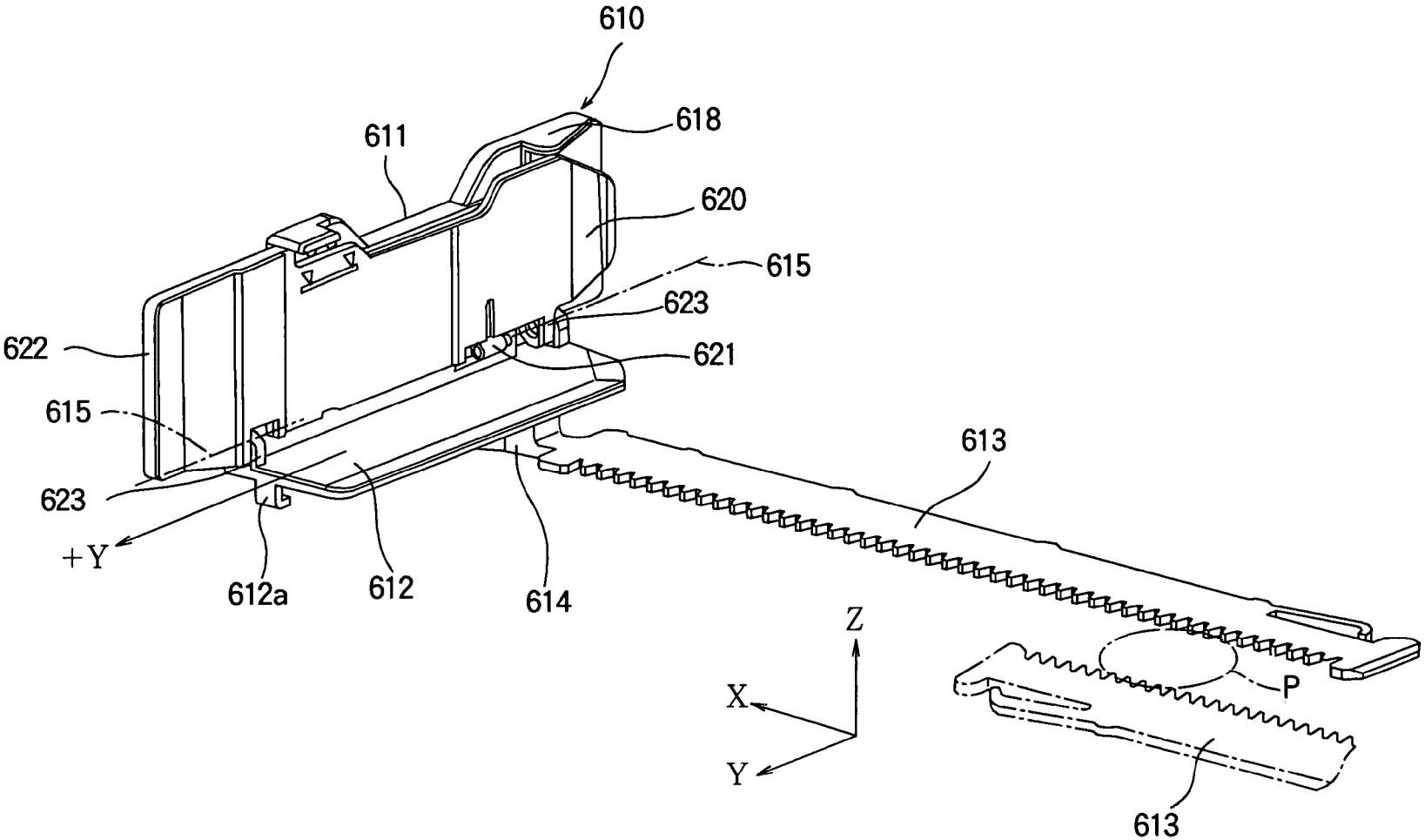
FIG. 5 is a perspective view showing a guide member and a retractable guide of the sheet feeding tray of the image forming apparatus according to the first embodiment of the present invention, in a state where the retractable guide is raised.
Figure 6:
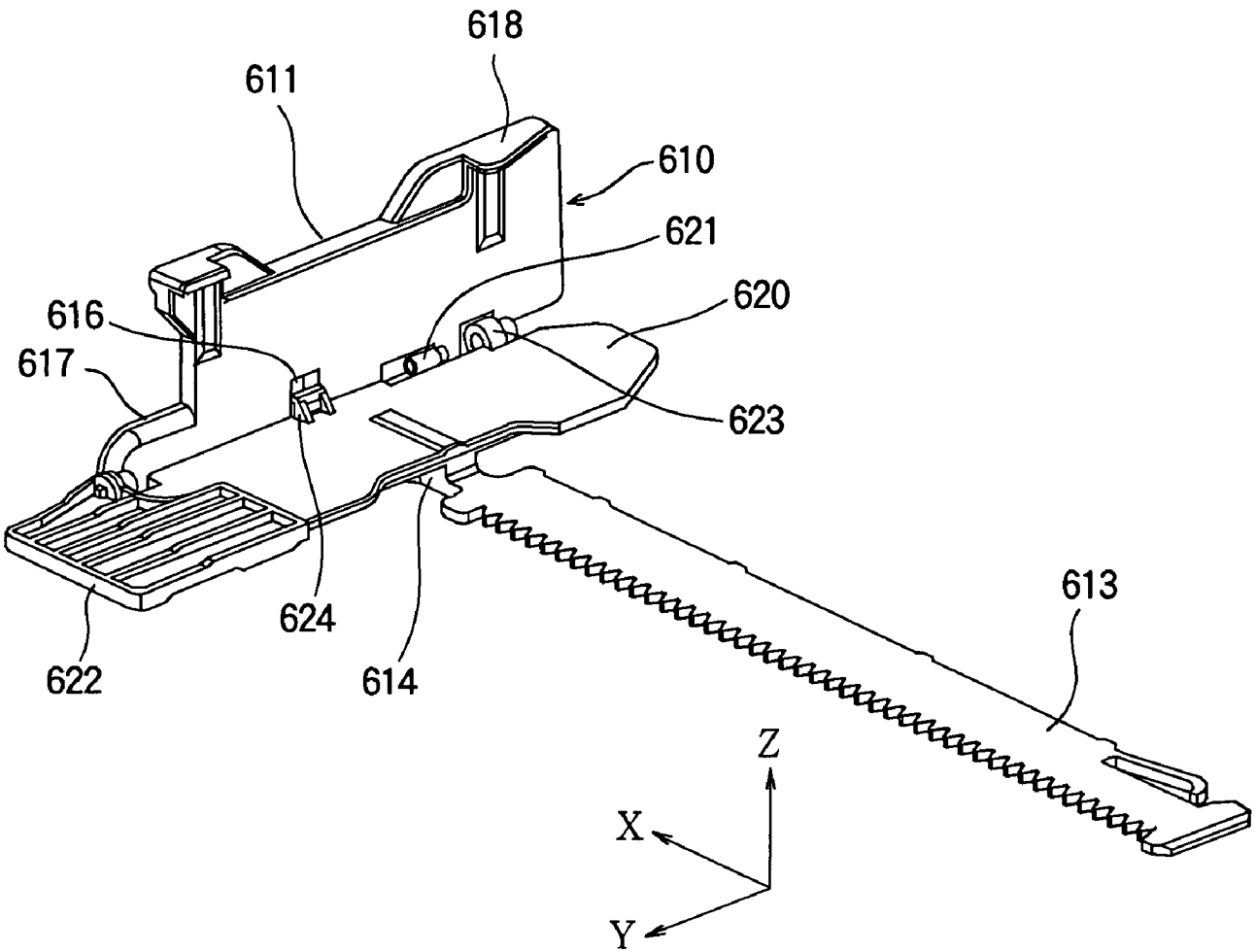
FIG. 6 is a perspective view showing the guide member and the retractable guide of the sheet feeding tray of the image forming apparatus according to the first embodiment of the present invention, in a state where the retractable guide is laid.
Figure 7:
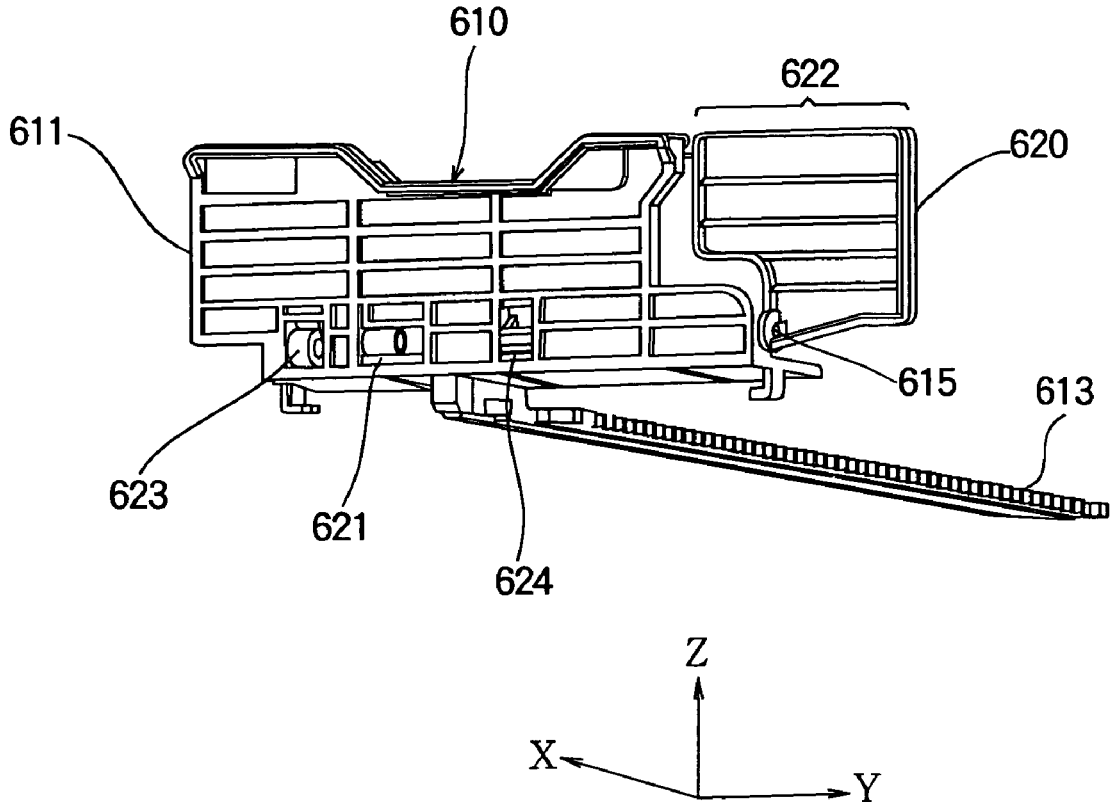
FIG. 7 is a perspective view showing the guide member and the retractable guide of the sheet feeding tray of the image forming apparatus according to the first embodiment of the present invention.

FIGS. 5 and 6 are perspective views showing the configuration of one of the guide members 610 and one of the retractable guides 620. FIG. 7 is a perspective view showing one of the guide members 610 as seen in the direction different from FIG. 5. The guide member 610 includes a support plate 612 provided in parallel to the placing plate 602 (FIG. 2), an upright plate (i.e., a raised portion) 611 perpendicularly raised from an outer end (in the X direction) of the support plate 612, and a rack portion 613 extending inwardly in the X direction from the support plate 612. The support plate 612 positions above the placing plate 602 (FIG. 2), and the rack portion 613 positions below the placing plate 602. A connecting portion 614 connecting the support plate 612 and the rack portion 613 penetrates a slit 602*b* (FIG. 2) formed on the placing plate 602 in the X direction. A pair of projections 612*a* (only one of which is shown in FIG. 5) project downward from both ends (in the Y direction) of the support plate 612 penetrate a pair of slits 602*a* (FIG. 2) formed on the placing plate 602. The other guide member 610 (not shown in FIG. 5) has a substantially symmetrical structure with respect to the center in the X direction. With such an arrangement, the guide members 610 are guided in the X direction. The rack portion 613 of the guide member 610 shown in FIG. 5 and the other rack portion 613 (shown by alternate long and short dash line in FIG. 5) of the other guide member 610 (not shown in FIG. 5) engage the same pinion P. Therefore, as one of the guide members 610 is slid in the X direction, the other of the guide members 610 is symmetrically slid with respect to the center in the X direction.

A pair of coaxial support shafts 615 (shown by alternate long and short dash line in FIG. 5) are provided in the vicinity of an end of the support plate 612 on the upright plate 611 side. The retractable guide 620 has shaft receiving portions 623 having through holes through which the support shafts 615 penetrate. The retractable guide 620 is swingable about the support shafts 615 between a laid position (FIG. 6) and a raised position (FIG. 5). In the laid position, the retractable guide 620 is laid in parallel to the support plate 612 as shown in FIG. 6. In the raised position, the retractable guide 620 is raised almost perpendicularly to the support plate 612 as shown in FIG. 5. The retractable guide 620 is larger in the Y direction than the upright plate 611 and projects in +Y direction by a predetermined amount, in order to surely guide the medium 601 fed toward the main body 110 and to prevent the skew of the medium 601. Moreover, the height of the retractable guide 620 in the Z direction is lower than the guide member 610, in order that a user can easily hold the guide member 610 for performing a guide width adjustment described later.

As shown in FIG. 6, a positioning claw 624 is provided on a surface of the retractable guide 620 on the upright plate 611 side. The positioning claw 624 engages a hole 616 formed on the upright plate 611 of the guide member 610. The positioning claw 624 and the hole 616 are provided for determining the position of the retractable guide 620 with respect to the guide member 610 in the Y direction, and for preventing the retractable guide 620 from being dropped out of the guide member 610. A return spring 621 (i.e., a pushing mechanism) is provided on the upright plate 611 of the guide member 610 via a not shown guide bar. The return spring 621 pushes the retractable guide 620 in the direction in which the retractable guide 620 swings to the upright plate 611.

As shown in FIGS. 5 and 7, the media 601 are stacked on the support plate 612 and the placing plate 602 (FIG. 2) in a state where the retractable guides 620 are raised as shown in FIGS. 5 and 7. The retractable guides 620 are configured to guide (i.e., restrict) both lateral ends of the media 601 (i.e., ends in the X direction) stacked on the support plate 612 and the placing plate 602. A projecting part 622 of each retractable guide 620 projecting from the guide member 610 in +Y direction has a structure whose strength is higher than other part the retractable guide 620, so as to efficiently prevent the skew of the medium 601. A bending portion 618 is formed on each upright plate 611 so as to prevent the stacked media 601 from being dropped out of the upright plate 611.

In a state where the pair of the guide members 610 are moved to outermost position in the X direction, a distance between the upright plates 611 is larger than the width (i.e., the dimension in the X direction) of the first supplemental tray 604. Therefore, when the first supplemental tray 604 is swung to the closing position as shown in FIG. 3, the first supplemental tray 604 is disposed between the respective upright plates 611 of the pair of the guide members 610. In this state, the first supplemental tray 604 is overlapped on the retractable guide 620. Thus, because of the weight of the first supplemental tray 604 (and the second supplemental trays 605 stored therein), the retractable guides 620 are kept laid, resisting the force of the return springs 621. In this state, the sheet feeding tray 600 is housed in the main body 110 (FIG. 1).

As shown in FIG. 2, a feeder frame 607 is provided on a fixing frame 606 formed on a wall of the main body 110 (FIG. 1). The feeder frame 607 supports the above described pickup roller 702. The feeder frame 607 is swingable about a swinging axis 607*a* (shown by alternate long and short dash line in FIG. 2) coaxial with the rotation axis of the above described feed roller 703. The rotation axis of the pickup roller 702 is displaced from the swinging axis 607*a* of the feeder frame 607. The feeder frame 607 is connected to hopper frames 685 (provided in the vicinities of both ends of the sheet feeding tray 600 in the X direction) via not shown stay, and the feeder frame 607 swings according to the swinging of the sheet feeding tray 600. When the sheet feeding tray 600 is in the vertical position, as shown in FIG. 4, the pickup roller 702 positions above the feed roller 703. When the sheet feeding tray 600 is in the horizontal position as shown in FIG. 2, the pickup roller 702 positions on the rear side of the feed roller 703 (i.e., adjacent to the feed roller 703 in −Y direction).

Shaft portions 607*b* are provided on both sides of the feeder frame 607 in the X direction, which define the swinging axis 607*a* of the feeder frame 607. A cutaway portion 617 (FIGS. 4 and 6) is formed on the upright plate 611 of each guide member 610 so that the upright plate 611 does not interfere with the shaft portion 607*b* of the feeder frame 607 when the sheet feeding tray 600 is swung to the vertical position.

Next, the operation of the sheet feeding tray 600 according to this embodiment will be described. When the sheet feeding tray 600 is to be used, a user holds the grip portion 683 (FIG. 3) and pulls the grip portion 683 in the direction away from the main body 110 (FIG. 1), so that the sheet feeding tray 600 is swung from the vertical position to the horizontal position at about 90 degrees. Then, the first supplemental guide 604 is swung from the closing position (FIG. 3) to the opening position (FIG. 2). By swinging the first supplemental guide 604 to the opening position, the retractable guides 620 are raised by the force of the return springs 621. In this state, the media 601 can be stacked on the placing plate 602 and inside between the pair of the retractable guides 620. If lengthy medium is used, it is possible to use the second supplemental trays 605 stored in the first supplemental tray 604, by swinging the second supplemental trays 605 to the projecting positions shown in FIG. 2.

A part (in +Y direction) of the placing plate 602 is lifted upward about the above described support shafts 602*c* (FIG. 2). The pickup roller 702 abuts against the surface of the uppermost medium 601 of the stacked media 601 on the placing plate 602. By the rotation of the pickup roller 702, the medium 601 is fed one by one to the interior of the main body 110. When the medium 601 is fed, both lateral ends of the medium 601 are guided by the pair of the retractable guides 620. Since the retractable guides 620 project from the guide members 610 in +Y direction and reach to the vicinity of the pickup roller 702, it is possible to surely guide the medium 601 (being fed) and to prevent the skew of the medium 601.

In order to adjust the distance between the retractable guides 620 to the width of the medium 601 (hereinafter, referred to as a guide width adjustment) the user holds the upright plate 611 of one of the guide members 610 and slides the guide member 610 in the X direction. Because of the engagement between the pinion P and the rack portions 613 (FIG. 5), both of the guide members 610 symmetrically slide with respect to the center in the X direction. With this, the distance between the pair of the retractable guides 620 supported by the guide members 610 can be adjusted to the width of the medium 601.

When the sheet feeding tray 600 is not in use, the user moves the pair of the guide members 610 to the outermost positions in the X direction. Further, if the second supplemental trays 605 are in the projecting positions, the user swings the second supplemental trays 605 about the support shafts 605*a* (FIG. 3) and houses the second supplemental trays 605 in the first supplemental tray 604. Then, the user lays the pair of the retractable guides 620, and then swings the first supplemental tray 604 from the opening position to the closing position. Because of the weight of the first supplemental tray 604 and the second supplemental trays 605, the retractable guides 620 are kept laid, resisting the force of the return springs 621 (FIG. 5). Then, the user holds the grip portion 683 (FIG. 3) and swings the sheet feeding tray 600 to the vertical position. With this, the sheet feeding tray 600 is housed in the main body 110 and the base plate 681 (FIG. 4) of the sheet feeding tray 600 constitutes a part of the wall of the main body 110. Further, the feeder frame 607 swings according to the swinging of the sheet feeding tray 600, so that the feed roller 703 moves to a position above the feed roller 703 from a position behind the feed roller 703.

As shown in FIG. 4, when the sheet feeding tray 600 is swung to the vertical position, the guide member 610 and the feeder frame 607 (FIG. 3) are housed in a space 606*a* inside the fixing frame 606. The tips of the guide members 610 are housed in concaves 606*b* formed in the space 606*a* of the fixing frame 606. The shaft portions 607*b* of the feeder frame 607 position in the cutaway portions 617 of the guide members 610 so that the shaft portions 607*b* and the guide members 610 do not interfere with each other.

In a state where the sheet feeding tray 600 is swung to the vertical position, the retractable guides 620 are longer than the guide members 610 in the vertical direction, and the lower ends of the retractable guides 620 reach to the vicinity of the feed roller 703 and the retard roller 704. However, since the retractable guides 620 are laid, the retractable guides 620 are housed in a space between the fixing frame 606 and the placing plate 602 without interfering with the feed roller 703 and the retard roller 704.

As described above, according to this embodiment, since the retractable guides 620 (capable of being laid) are provided, it is possible to reduce a recess space in the main body 110 even when the retractable guides 620 are large, and therefore the downsizing of the image forming apparatus can be accomplished. Particularly, since the retractable guides 620 are longer than the guide members 610 in the Y direction (i.e., the feeding direction of the medium 601), it is possible to surely guide the medium 601 being fed. Accordingly, even if the medium 601 is small in the Y direction, the medium 601 is still guided by the retractable guides 620 when the tip of the medium 601 reaches the feed roller 703 and the retard roller 704. Therefore, it is possible to effectively prevent the skew of the medium 601.

Moreover, if the medium 601 is guided only by the retractable guides 620, an operation to hold the retractable guides 620 and move the retractable guides 620 in the X direction (for the guide width adjustment) is not easy because the retractable guides 620 tend to be easily laid. Conversely, in this embodiment, it is possible to move the retractable guides 620 in the X direction by holding the upright plates 611 (which are not laid) of the guide members 610 and move the guide members 610 in the X direction. Therefore, the guide width adjustment can be easily carried out.

In this embodiment, the heights of the retractable guides 620 are set to be lower than the guide members 610. However, the heights of the retractable guides 620 can be set to be higher than the guide members 610. In such a case, there is an advantage that a larger amount of media 601 can be stacked in the sheet feeding tray 600.

Further, in this embodiment, the retractable guides 620 are provided on both guide members 610. However, it is also possible to provide one retractable guide 620 on only one of the guide members 610. In such a case, there is an advantage that a recess space in the main body 110 can be reduced at a side where the retractable guide 620 is provided.

Second Embodiment

Figure 8:
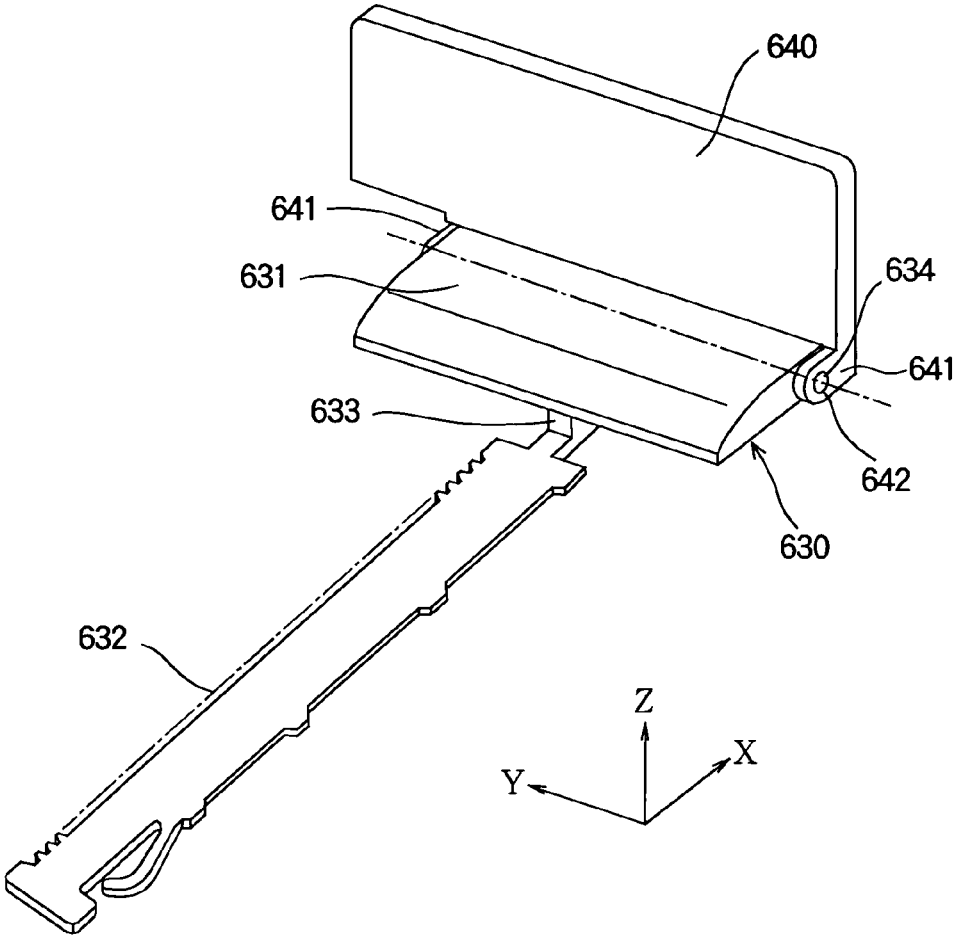
FIG. 8 is a perspective view showing a guide member and a retractable guide of a sheet feeding tray of an image forming apparatus according to the second embodiment of the present invention.

FIG. 8 is a perspective view showing one of guide members 630 and one of retractable guides 640 of a sheet feeding tray of an image forming apparatus according to the second embodiment. The second embodiment is different from the first embodiment in the configuration of the guide members 630 and the retractable guides 640. Other configuration is the same as the first embodiment. Each of the guide members 630 includes a support plate 631 provided in parallel to the placing plate 602 (FIG. 2) and a rack portion 632 extending in the X direction, but does not include an upright plate.

As in the first embodiment, the support plate 631 positions above the placing plate 602 (FIG. 2), and the rack portion 632 positions below the placing plate 602. A connecting portion 633 that connects the support plate 631 and the rack portion 632 penetrates the slit 602*b* (FIG. 2) formed on the placing plate 602. Although omitted in FIG. 8, a pair of projections 612*a* (FIG. 5) project downward from both ends of the support plate 631 in the Y direction, and penetrate the slit 602*a* (FIG. 2) formed on the placing plate 602. With such an arrangement, the guide members 630 are guided in the X direction. As in the first embodiment, the rack portion 632 of the guide member 630 shown in FIG. 8 and the other rack portion 632 of the other guide member 630 engage the same pinion P (FIG. 5).

A pair of retractable guides 640 are provided on the guide members 630, which guide both ends of the media 601 (FIG. 1) in the X direction. A pair of support shafts 634 (only one of which is shown in FIG. 8) project in the Y direction from both end surfaces of the guide member 630. The support shafts 634 engage engaging holes 642 formed on a pair of engaging pieces 641 projecting in the X direction from the lower end of the retractable guide 640.

Figure 9:
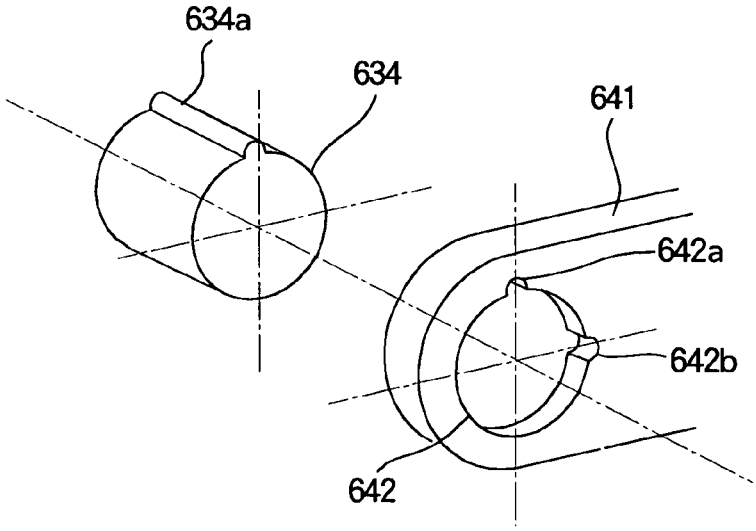
FIG. 9 is an enlarged perspective view showing a connecting portion between the guide member and the retractable guide of the sheet feeding tray of the image forming apparatus according to the second embodiment of the present invention.

FIG. 9 is a schematic view showing the engagement between each support shaft 634 and each engaging hole 642. As shown in FIG. 9, the support shaft 634 is almost in the form of a cylinder, and has a convex portion 634*a* in one place in the circumferential direction thereof. The engaging hole 642 has concave portions 642*a* and 642*b* in two places in the circumferential direction thereof. The convex portions 642*a* and 642*b* are apart from each other at about 90 degrees in the circumferential direction of the engaging hole 642. The support shaft 634 is rotatable in the engaging hole 642 so that the support shaft 634 contacts the inner surface of the engaging hole 642. The support shaft 634 is stopped at rotational positions where the convex portion 634*a* engages the concave portion 642*a* or the concave portion 642*b*.

Figure 10B:
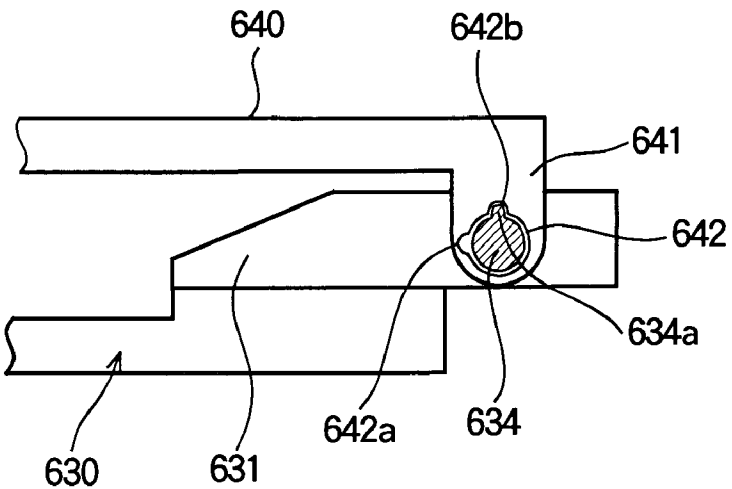
FIGS. 10A and 10B are schematic views illustrating an operation of the retractable guide of the sheet feeding tray of the image forming apparatus according to the second embodiment of the present invention.
Figure 10A:
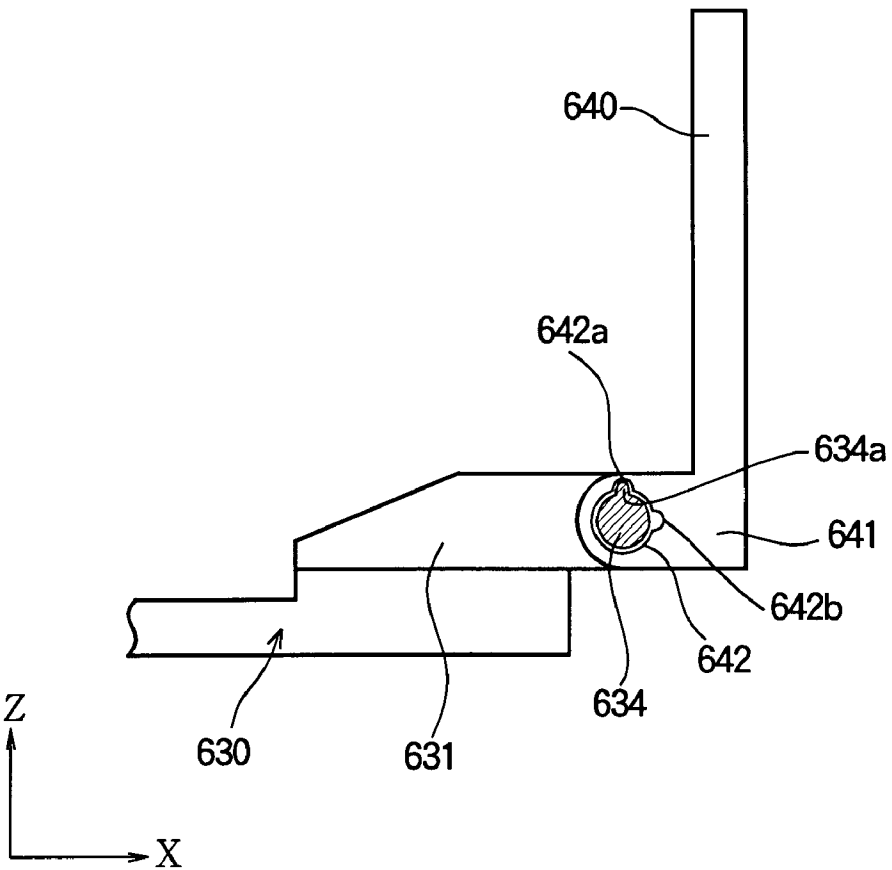

FIGS. 10A and 10B are schematic views showing an operation of the retractable guide 640. As shown in FIG. 10A, when the convex portion 634*a* of the support shaft 634 engages the concave portion 642*a* of the engaging hole 642, the retractable guide 640 is in the raised position, i.e., the retractable guide 640 is raised almost perpendicularly to the support plate 631. As shown in FIG. 10B, when the convex portion 634*a* of the support shaft 634 engages the concave portion 642 of the engaging hole 642, the retractable guide 640 is in the laid position, i.e., the retractable guide 640 is laid in almost parallel to the support plate 631. Thus, even when the user applies the force (in the X direction) to the retractable guide 640 in the raised position, the retractable guide 640 is not laid, unless the applied force is strong enough to disengage the convex portion 634*a* from the concave portion 642*a*. Other configuration is the same as the first embodiment.

Next, the operation of the sheet feeding tray according to this embodiment will be described. The operation that the user swings the sheet feeding tray from the vertical position to the horizontal position is the same as that described in the first embodiment. However, in this embodiment, the retractable guides 640 are not raised by only swinging the first supplemental tray 604 (FIG. 2) from the closing position to the opening position. Therefore, the user applies a force to the retractable guides 640 sufficient for disengaging the convex portions 634*a* and the concave portions 642*b*, and swings the retractable guides 640 to the raised position. As the retractable guides 640 are swung to the raised position, the convex portions 634*a* of the support shafts 634 engage the concave portions 642*a* of the engaging holes 642. In this state, it is possible to stack the media 601 on the placing plate 602 and inside the pair of the retractable guides 640 in the X direction. Since the retractable guides 640 have sufficient length in the Y direction, it is possible to guide the medium 601 and to prevent the skew of the medium 601.

In order to carry out the guide width adjustment, the user holds the retractable guides 640 and moves the retractable guides 640 in the X direction. By applying a force to each retractable guide 640 in a level in which the convex portion 634*a* of the support shaft 634 does not disengage from the concave portion 642*a* of the engaging hole 642, the retractable guides 640 move in the X direction without being laid. Further, because of the engagement between the pinion and the rack portions 632, both guide members 630 (and the retractable guides 640) symmetrically slide with each other, as was described in the first embodiment. In this embodiment, since a lock mechanism including the convex portions 634*a* of the support shafts 634 and the concave portions 642*a* and 642*b* of the engaging holes 642 is provided, it is possible to prevent the retractable guides 640 from being laid during the guide width adjustment. Thus, the guide width adjustment can be easily carried out.

When the sheet feeding tray is not in use, the user pushes the retractable guides 640 by a force sufficient for disengaging the convex portions 634*a* and the concave portions 642*a*, and swings the retractable guides 640 from the raised position to the laid position. In this state, the user swings the first supplemental tray 604 (FIG. 2) about the support shafts 604*a* so that the first supplemental tray 604 is overlapped on the placing plate 602 in parallel to the placing plate 602 (i.e., laid on the placing plate 602). Then, the user swings the sheet feeding tray to the vertical position so that the sheet feeding tray is housed in the main body 110 (FIG. 1).

As described above, according to this embodiment, since the lock mechanism (the convex portions 634*a* of the support shafts 634 and the concave portions 642*a* and 642*b* of the engaging holes 642) is provided, it becomes possible to slide the retractable guides 640 without causing the retractable guides 640 to be laid, and therefore the guide width adjustment can be easily carried out.

Moreover, in this embodiment, no upright portion remains on the guide members 630 after the retractable guides 640 are laid. Therefore, a recess space in the main body 110 can be reduced, even when the heights of the retractable guides 640 are increased. Thus, it becomes possible to stack a larger number of the media in the sheet feeding tray.

Furthermore, in the above described first embodiment, the upright plates 611 of the guide members 610 remain raised after the retractable guides 640 are laid, and therefore it is necessary to move the guide members 610 to the outermost positions in the X direction before the first supplemental tray 604 is swung to the closing position. However, in this embodiment, no upright portion remains on the guide members 630 after the retractable guides 640 are laid, and therefore it is not necessary to move the guide members 610 to the outermost positions in the X direction before the first supplemental tray 604 is swung to the closing position.

In this embodiment, the retractable guides 640 are locked at the raised position (FIG. 10A) and the laid position (FIG. 10B). However, it is possible to lock the retractable guides 640 only at the raised position.

Third Embodiment

Figure 11:
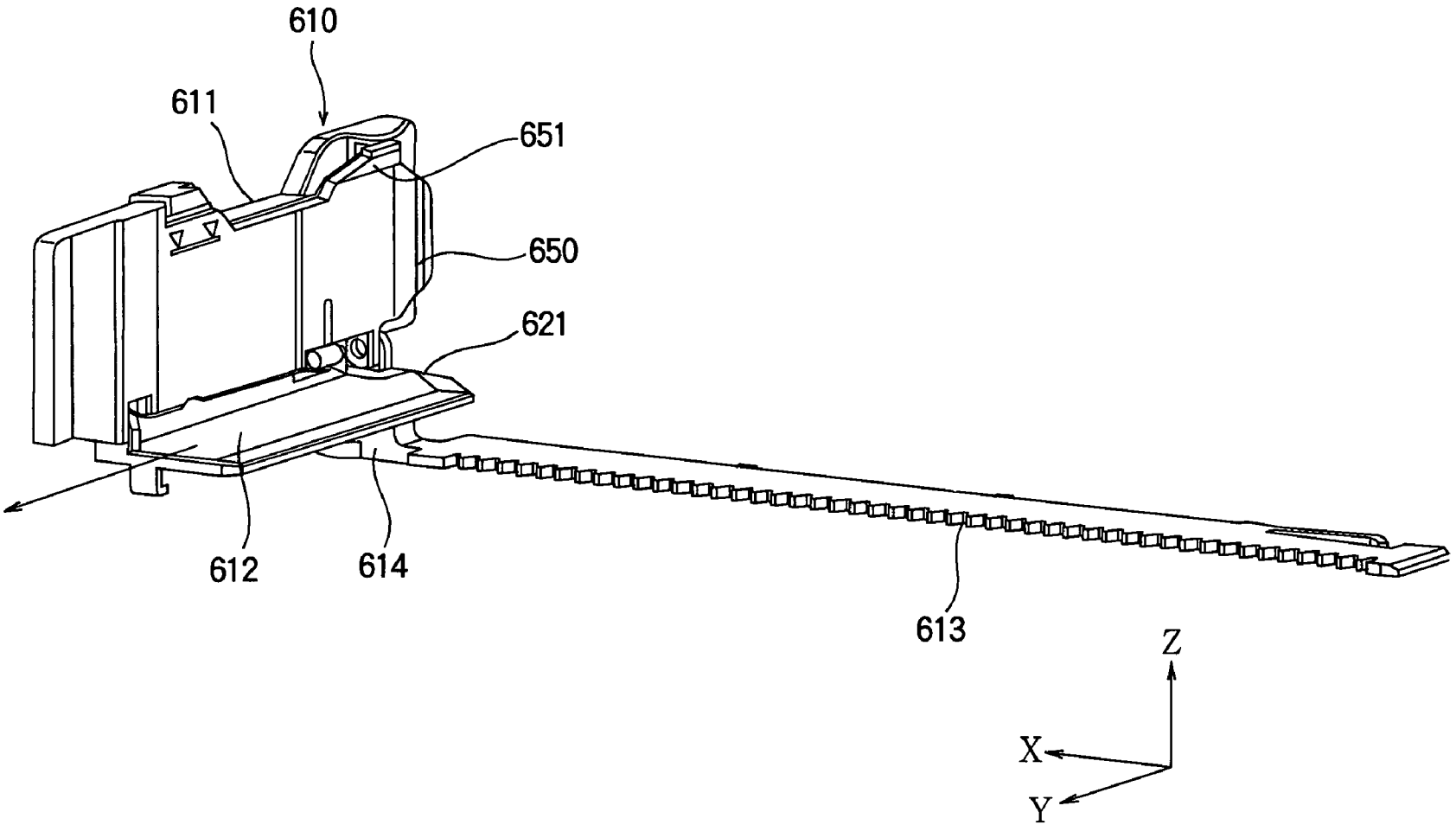
FIG. 11 is a perspective view of a guide member and a retractable guide of a sheet feeding tray of an image forming apparatus according to the third embodiment of the present invention.

FIG. 11 is a perspective view showing one of guide members 610 and one of retractable guides 650 of a sheet feeding tray of an image forming apparatus according to the third embodiment of the present invention. The third embodiment is different from the first embodiment in that the retractable guides 650 are moved in conjunction with the swinging of the first supplemental tray 660.

Each retractable guide 650 has a projection 651 formed on a top end thereof (i.e., a farthest end from the support plate 612 of the guide member 610 when the retractable guide 650 is raised). The projections 651 are so constructed that the first supplemental tray 660 abuts against the projections 651 when the first supplemental tray 660 is swung from the opening position to the closing position. Here, each of the projections 651 is formed in the vicinity of an end of the retractable guide 650 in Y-direction.

Figure 12:
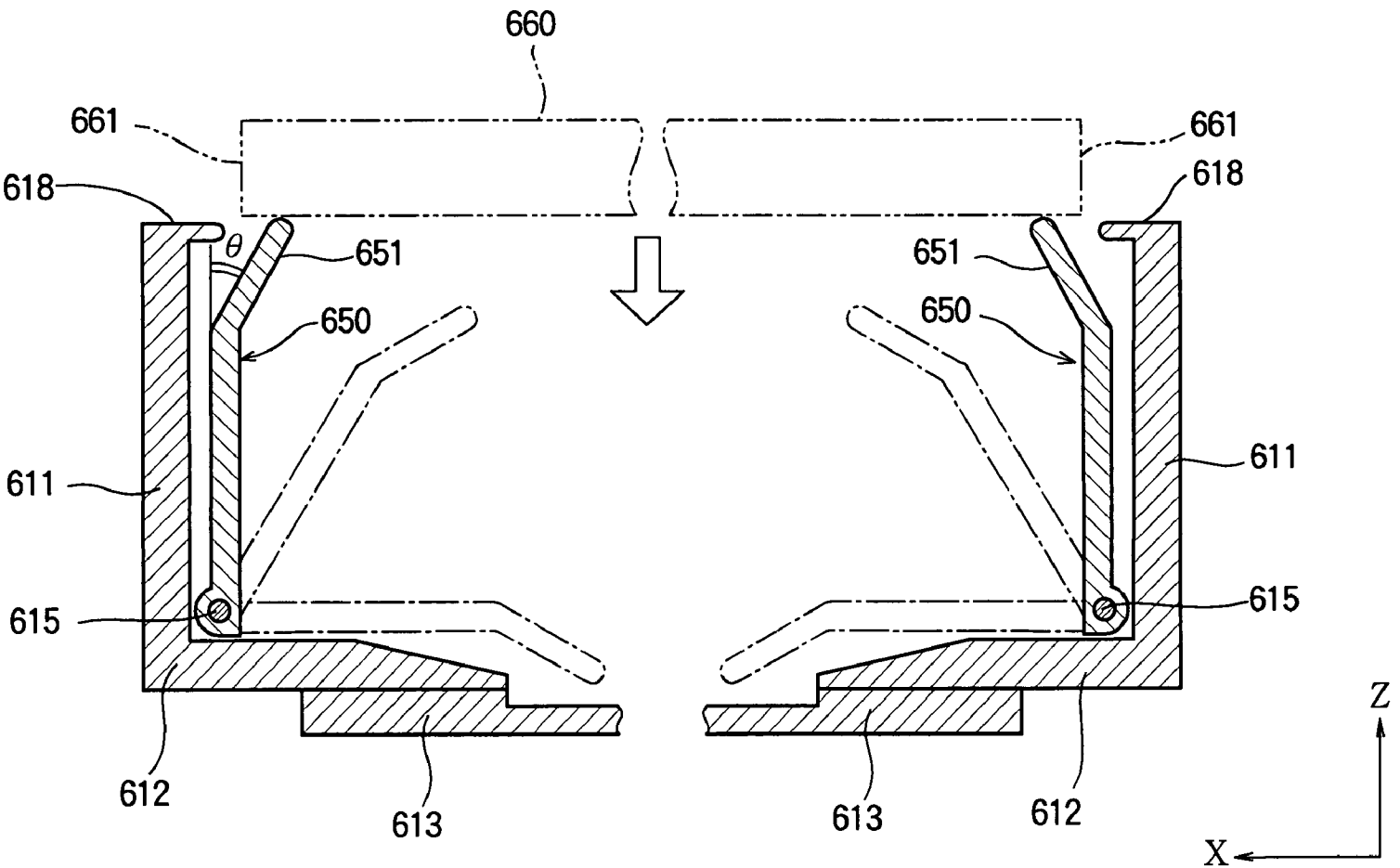
FIG. 12 is a schematic view for illustrating an operation of the retractable guide of the sheet feeding tray of the image forming apparatus according to the third embodiment of the present invention.

FIG. 12 is a schematic view showing a configuration (cross section along XZ plane) of the retractable guides 650 and an operation thereof. In a state where the pair of the retractable guides 650 are in the raised position, the projections 651 are inwardly inclined with respect to +Z direction at an angle θ (from 0 to 90 degrees). The projecting amount of each projection 651 is so set that the projection 651 does not interfere with the stacking of the media 601 inside the pair of the retractable guides 650.

Figure 13:
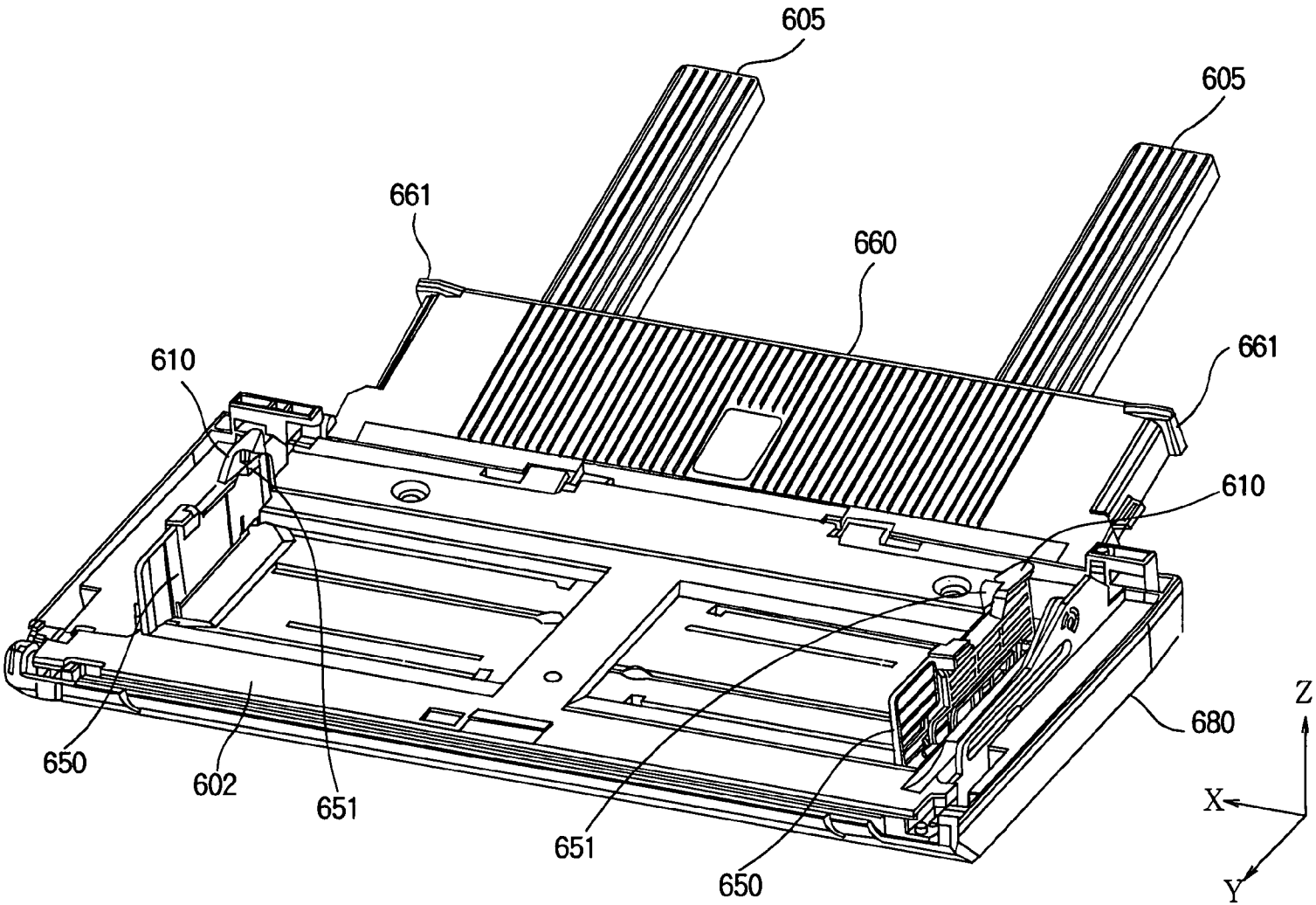
FIG. 13 is a schematic view showing the sheet feeding tray of the image forming apparatus according to the third embodiment of the present invention, in a state where a supplemental tray is opened.
Figure 14:
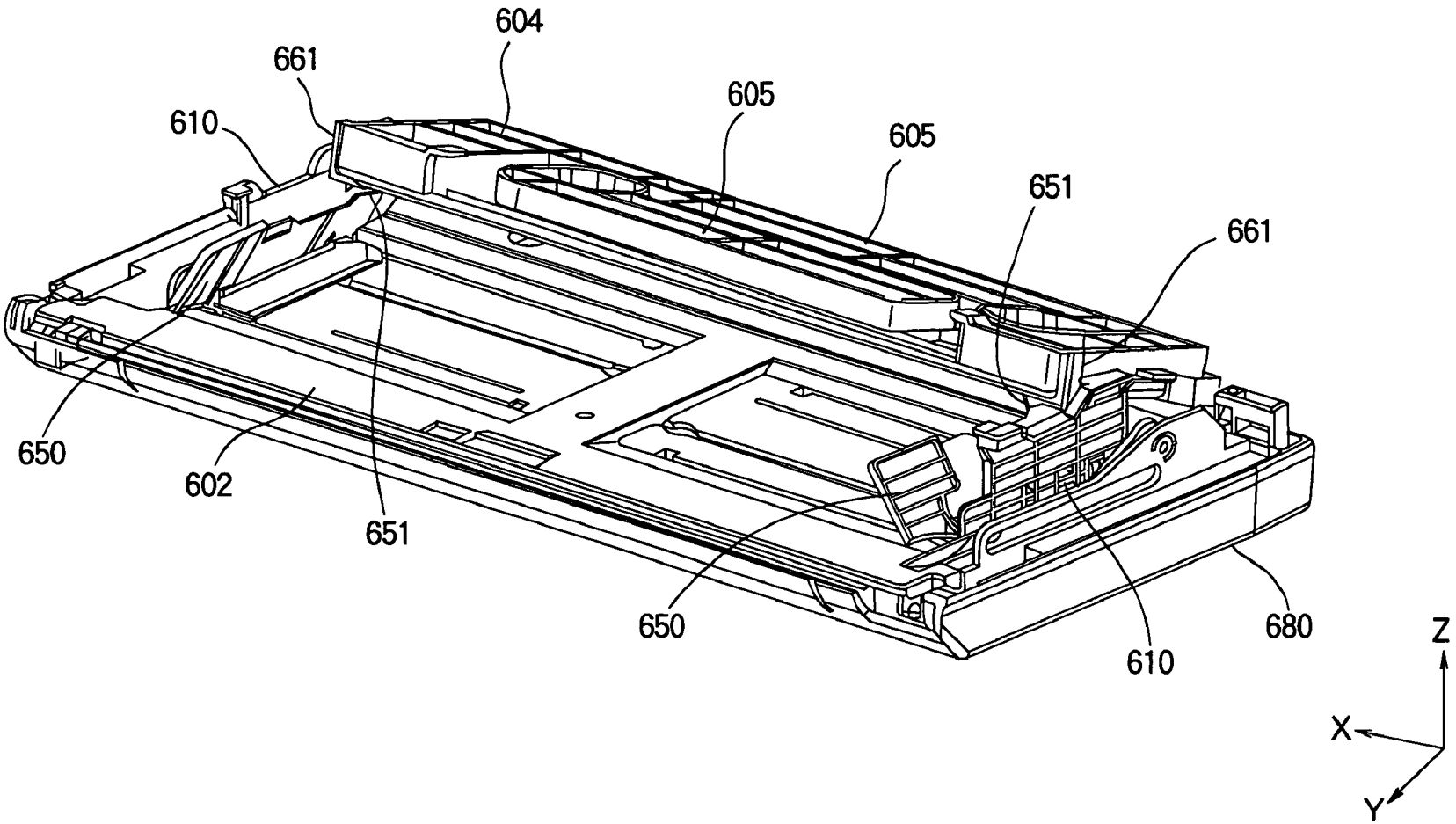
FIG. 14 is a schematic view showing the sheet feeding tray of the image forming apparatus according to the third embodiment of the present invention, in a state where the supplemental tray is closed.

FIGS. 13 and 14 are perspective views of the sheet feeding tray according to the third embodiment. FIG. 13 shows the condition in which the first supplemental tray 660 is swung to the opening position, and FIG. 14 shows the condition in which the first supplemental tray 660 is swung to the closing position. A pair of protrusions 661 are formed on both ends of the first supplemental tray 660 in the X direction, and protrude outwardly in the X direction. The protrusions 661 are so disposed that the protrusions 661 abut against the projections 651 of the retractable guides 650 from above, when the first supplemental tray 660 is swung from the opening position to the closing position. Other configuration is the same as the first embodiment.

Next, the operation of the sheet feeding tray according to this embodiment will be described. The operation for using the sheet feeding tray is the same as that described in the first embodiment. That is, the user swings the sheet feeding tray from the vertical position to the horizontal position, and swings the first supplemental tray 660 from the closing position to the opening position, so that the retractable guides 650 swing (i.e., pop up) to the raised position by means of the force of the return springs 621 (FIG. 5).

When the sheet feeding tray is not in use, the user moves both guide members 610 to the outermost positions in the X direction, and then swings the first supplemental tray 660 from the opening position to the closing position, as was described in the first embodiment. During the swinging of the first supplemental tray 660 to the closing position, the protrusions 661 of the first supplemental tray 660 abut against the projections 651 of the retractable guides 650 from above, as shown in FIGS. 12 and 14. Due to the inclination of the projections 651, the retractable guides 650 swing to the laid position, as the first supplemental tray 660 swings close to the closing position. Due to a turning moment caused by the weight of the first supplemental tray 660 and the second supplemental trays 605 (stored in the first supplemental tray 660), the retractable guides 650 are laid resisting the force of the return springs 621 (FIG. 5). As the retractable guides 650 are laid, the sheet feeding tray can be housed in the main body 110, as was described in the first embodiment.

As described above, according to this embodiment, the retractable guides 650 are laid in conjunction with the swinging of the first supplemental tray 660 to the closing position, and raised in conjunction with the swinging of the first supplemental tray 660 to the opening position. Therefore, in addition to the advantages described in the first embodiment, the operability can be further enhanced.

In this embodiment, the retractable guides 650 are raised by the force of the return springs 621 (when the first supplemental tray 660 is in the opening position) and are laid by being pushed by the protrusions 661 of the first supplemental tray 660 (when the first supplemental tray 660 swings to the closing position). However, it is also possible to connect the first supplemental tray 660 and the retractable guides 650 via a link mechanism, so that the retractable guides 650 are raised and laid in accordance with the swinging of the first supplemental tray 660.

Fourth Embodiment

Figure 15:
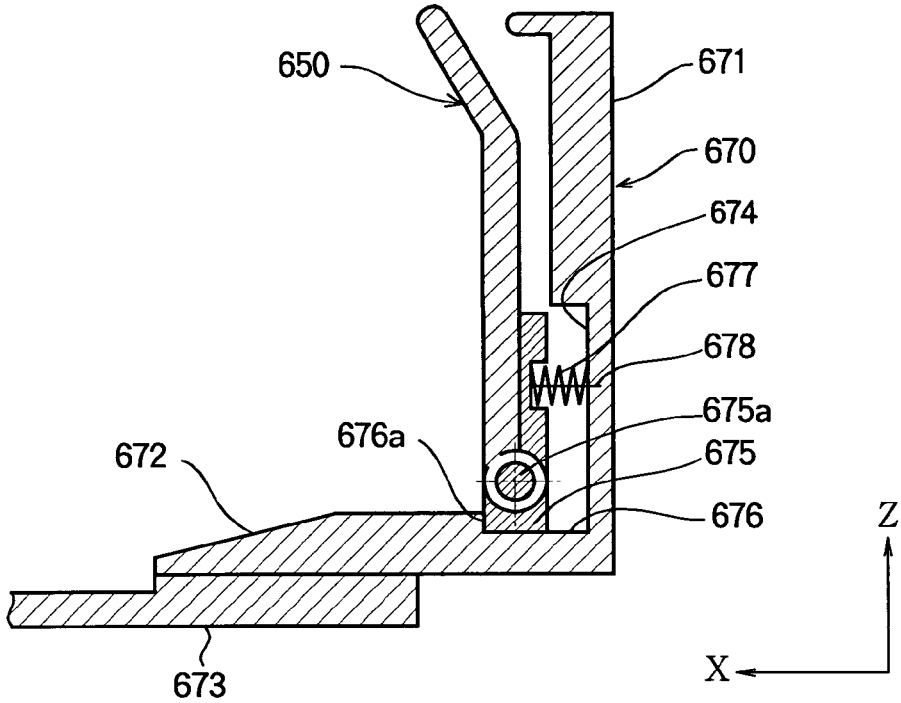
FIG. 15 is a schematic view showing a guide member and a retractable guide of a sheet feeding tray of an image forming apparatus according to the fourth embodiment of the present invention.

FIG. 15 is a cross section of one of guide members 670 and one of retractable guides 650 of a sheet feeding tray of an image forming apparatus according to the fourth embodiment of the present invention, taken along XZ plane. The fourth embodiment employs the configuration in which the retractable guides 650 are moved in conjunction with the swinging of the first supplemental tray 660, as in the third embodiment. However, the fourth embodiment is different from the third embodiment in that one of the retractable guides 650 is supported by the guide member 670 via a movable body 671 slidable in the X direction.

In this embodiment, among two pairs of the retractable guides 650 and the guide members 670 provided on both sides of the placing plate 602 (FIG. 2) in the X direction, one of the retractable guides 650 is mounted on the guide member 670 via the movable body 675 slidable in the X direction. The guide member 670 includes a support plate 672 provided in almost parallel to a placing plate 602 (FIG. 2), an upright plate 671 raised from an outer end (in the X direction) of the support plate 672 almost perpendicularly to the support plate 672, and a rack portion 673 extending inwardly in the X direction from the support plate 672.

A groove 676 of a predetermined length in the X direction is formed on an end of the support plate 672 in the vicinity of the upright plate 671. The above described movable body 675 is disposed in the groove 676. The dimension of the movable body 675 in the X direction is shorter than the length of the groove 676 in the X direction, so that the movable body 675 is slidable in the groove 676 in the X direction. A recess 674 is formed on an inner surface of the upright plate 671 in the X direction. The recess 674 has a size in which the movable body 675 can be held. A lateral force spring 677 (i.e., a pushing member) is provided in the recess 674 via a guide bar 678. The lateral force spring 677 pushes the movable body 675 inwardly in the X direction. In a state where the media 601 are not stacked in the sheet feeding tray, the movable body 671 abuts against an inner end portion 676*a* of the groove 676 in the X direction, so that the position of the movable body 671 is restricted.

Figure 16:
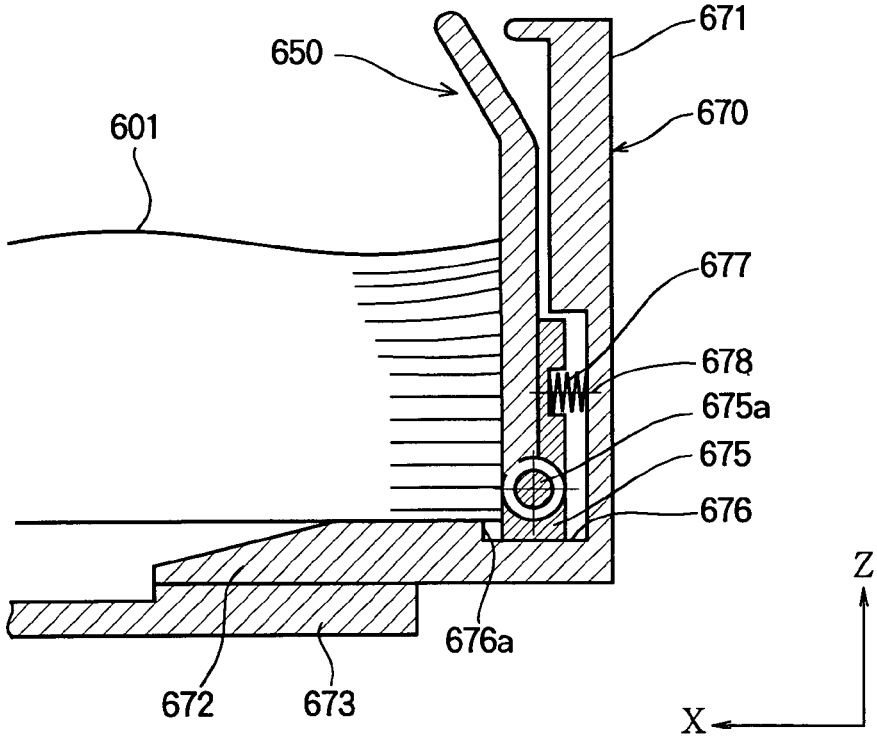
FIG. 16 is a schematic view for illustrating an operation of the retractable guide of the sheet feeding tray of the image forming apparatus according to the fourth embodiment of the present invention.

FIG. 16 is a cross section of the guide member 670 and the retractable guide 650 in a state where the media 601 are stacked in the sheet feeding tray, taken along XZ plane. When the media 601 are stacked in the sheet feeding tray, the media 601 force the retractable guide 650 outwardly in the X direction, with the result that the retractable guide 650 moves outwardly in the X direction resisting the force of the lateral force spring 677. The force of the lateral force spring 677 is set to be relatively low so that the lateral force spring 677 lightly restricts the position of the media 601 in the X direction. In particular, the lateral force spring 677 is not so strong, and does not deform the medium 601 to get winkled even when one thin medium 601 is placed. Other configuration is the same as the first embodiment.

Next, the operation of the sheet feeding tray according to this embodiment will be described. When the media 601 (hereinafter, referred to as a media stack) are stacked in the sheet feeding tray, there is a case in which lateral ends (i.e., ends in the X direction) of the media 601 are not aligned with each other. For example, the widths of the media 601 may not be uniform and may be varied. Further, when additional media stack is piled on the media stack, there may be a stepped portion at a boundary of the piled media stacks. Here, consideration will be made to the case in which lateral ends of the media 601 are not aligned with each other (i.e., the variation of the width of the media 601 is large) in an upper pile of the stack, and lateral ends of the media 601 are aligned with each other in a lower pile of the stack. If the guide width adjustment is carried out after the media stack is placed on the placing plate 602, the position of the retractable guide in the X direction is determined based on the upper pile of the stack. Thus, when the medium 601 at the lower pile of the stack is fed, there is a possibility that a gap may be formed between the medium 601 and the retractable guide. In such a case, a print starting position on the medium 601 may deviate in the X direction, or the skew of the medium 601 may occur.

Conversely, in this embodiment, the retractable guide 650 is pushed inwardly in the X direction by means of the lateral force spring 677, and therefore a gap between the lateral end of the medium 601 (in the X direction) and the retractable guide 650 can be minimized, even when there is a variation in widths of the media 601 of the stack. Thus, the deviation of the print starting position on the medium 601 can be prevented, and the skew of the medium 601 can be prevented. The operation for using the sheet feeding tray and the operation for housing the sheet feeding tray in the main body are the same as those described in the third embodiment.

As described above, in this embodiment, in addition to the advantages of the first through third embodiments, it is possible to prevent the deviation of the print starting position on the medium and the skew of the medium 601 due to the lateral play of the medium.

In this embodiment, only one of the pair of the retractable guides 650 is mounted on the movable body 675. However, it is possible that both retractable guides 650 are respectively mounted on movable bodies 675. Moreover, the arrangement in which the retractable guide 650 pushes the media 601 inwardly in the X direction by means of the force of the lateral force spring 677 can be applied to the sheet feeding tray of the first or third embodiment.

The first through third embodiments are described on the assumption that the sheet feeding tray is housed in the main body when the sheet feeding tray is not in use. However, the present invention can also be applied to a configuration in which the sheet feeding tray is not housed in the main body.

Even in such a case, there is an advantage that the sheet feeding tray can be compact when the sheet feeding tray is not in use.

The present invention is not limited to the sheet feeding tray of the electrophotographic printer, but can be used as a sheet feeding tray of an image forming apparatus (for example, a copier, a facsimile and a printer) that forms image on the media by means of various printing method.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising a medium storing portion attached to a main body, said medium storing portion comprising:

a placing surface on which at least one medium can be placed, a movable supplemental tray, and a retractable guide configured to be laid in conjunction with a movement of said supplemental tray, said retractable guide restricting the end of said medium placed on said placing surface, wherein the movement of the supplemental tray is transmitted to the retractable guide to cause the retractable guide to be laid.

2. The image forming apparatus according to claim 1, wherein said retractable guide restricts the end of said medium placed on said placing surface in a state where said retractable guide is raised substantially perpendicularly to said placing surface, and said medium storing portion can be housed in said main body in a state where said retractable guide is laid substantially in parallel to said placing surface.

3. The image forming apparatus according to claim 1, further comprising a pushing mechanism that pushes said retractable guide to a position substantially perpendicular to said placing surface.

4. The image forming apparatus according to claim 1, wherein said medium storing portion includes a guide member that supports said retractable guide, and a position of said guide member is adjustable in a direction substantially parallel to said placing surface.

5. The image forming apparatus according to claim 4, wherein said guide member has a raised portion raised with respect to said placing surface.

6. The image forming apparatus according to claim 5, wherein said medium storing portion can be housed in said main body in a state where said guide member is in a predetermined position.

7. The image forming apparatus according to claim 1, wherein said supplemental tray is swingable.

8. The image forming apparatus according to claim 4, wherein said guide member includes a pushing member that pushes said retractable guide in a direction in which said retractable guide contacts the end of said medium.

9. A medium feeding mechanism mounted on a main body of an image forming apparatus, said medium feeding mechanism comprising;

a placing surface on which at least one medium can be placed, a movable supplemental tray, and a retractable guide configured to be laid in conjunction with a movement of said supplemental tray, said retractable guide restricting the end of said medium placed on said placing surface, wherein the movement of the supplemental tray is transmitted to the retractable guide to cause the retractable guide to be laid.

10. The medium feeding mechanism according to claim 9, wherein said retractable guide restricts the end of said medium placed on said placing surface in a state where said retractable guide is raised substantially perpendicularly to said placing surface, and said medium storing portion can be housed in said main body in a state where said retractable guide is laid substantially in parallel to said placing surface.

11. The medium feeding mechanism according to claim 9, further comprising a pushing mechanism that pushes said retractable guide to a position substantially perpendicular to said placing surface.

12. The medium feeding mechanism according to claim 9, wherein said medium storing portion includes a guide member that supports said retractable guide, and a position of said guide member is adjustable in a direction substantially parallel to said placing surface.

13. The medium feeding mechanism according to claim 12, wherein said guide member has a raised portion raised with respect to said placing surface.

14. The medium feeding mechanism according to claim 13, wherein a said medium storing portion can be housed in said main body in a state where said guide member is in a predetermined position.

15. The medium feeding mechanism according to claim 9, wherein said supplemental tray is swingable.

16. The medium feeding mechanism according to claim 12, wherein said guide member includes a pushing member that pushes said retractable guide in a direction in which said retractable guide contacts the end of said medium.

17. The image forming apparatus according to claim 5, wherein said retractable guide protrudes with respect to said raised portion in a direction parallel to a feeding direction of said medium.

18. The image forming apparatus according to claim 4, wherein a height of said retractable guide in a state where said retractable guide is raised is lower than said guide member.

19. The image forming apparatus according to claim 1, wherein said retractable guide includes a projecting portion which is inclined in a direction in which said retractable guide is to be laid.

20. The medium feeding mechanism according to claim 13, wherein said retractable guide protrudes with respect to said raised portion in a direction parallel to a feeding direction of said medium.

21. The medium feeding mechanism according to claim 13, wherein a height of said retractable guide in a state where said retractable guide is raised is lower than said raised portion.

22. The medium feeding mechanism according to claim 13, wherein said retractable guide includes a projecting portion which is inclined in a direction in which said retractable guide is to be laid.

23. An image forming apparatus comprising a medium storing portion attached to a main body, said medium storing portion comprising:

a placing surface on which at least one medium can be placed, a retractable guide that restricts the end of said medium placed on said placing surface, and a raised portion that is raised in a stacking direction of the medium, and which substantially overlaps the retractable guide along a side of said retractable guide opposite a side facing said end of said medium.

24. The image forming apparatus according to claim 23, further comprising a pushing mechanism that pushes said retractable guide to a position substantially perpendicular to said placing surface.

25. The image forming apparatus according to claim 23, wherein said raised portion is provided on a guide member that supports said retractable guide, and wherein said medium storing portion can be housed in said main body in a state where said guide member is in a predetermined position.

26. The image forming apparatus according to claim 25, wherein said guide member includes a pushing member that pushes said retractable guide in a direction in which said retractable guide contacts the end of said medium.

27. The image forming apparatus according to claim 23, wherein said retractable guide protrudes with respect to said raised portion in a direction parallel to a feeding direction of said medium.

28. The image forming apparatus according to claim 23, wherein a height of said retractable guide in a state where said retractable guide is raised is lower than said raised portion.

29. A medium feeding mechanism mounted on a main body of an image forming apparatus, said medium feeding mechanism comprising;

a placing surface on which at least one medium can be placed, a retractable guide that restricts the end of said medium placed on said placing surface, and a raised portion that is raised in a stacking direction of the medium, and which substantially overlaps the retractable guide along a side of said retractable guide opposite a side facing said end of said medium.

30. The medium feeding mechanism according to claim 29, further comprising a pushing mechanism that pushes said retractable guide to a position substantially perpendicular to said placing surface.

31. The medium feeding mechanism according to claim 29, wherein said raised portion is provided on a guide member that supports said retractable guide, and wherein said medium storing portion can be housed in said main body in a state where said guide member is in a predetermined position.

32. The medium feeding mechanism according to claim 31, wherein said guide member includes a pushing member that pushes said retractable guide in a direction in which said retractable guide contacts the end of said medium.

33. The medium feeding mechanism according to claim 29, wherein said retractable guide protrudes with respect to said raised portion in a direction parallel to a feeding direction of said medium.

34. The medium feeding mechanism according to claim 29, wherein a height of said retractable guide in a state where said retractable guide is raised is lower than said raised portion.

* * * * *

UNITED STATES PATENT AND TRADEMARK OFFICE

CERTIFICATE OF CORRECTION

PATENT NO. : 7,618,038 B2
APPLICATION NO. : 11/250214
DATED : November 17, 2009
INVENTOR(S) : Koji Aida It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 421 days.

Signed and Sealed this

Nineteenth Day of October, 2010

David J. Kappos

David J. Kappos
*Director of the United States Patent and Trademark Office*